US008128409B2

(12) United States Patent
Feller

(10) Patent No.: US 8,128,409 B2
(45) Date of Patent: Mar. 6, 2012

(54) METHOD AND SYSTEM FOR IMPROVING INTERPERSONAL COMMUNICATION

(76) Inventor: Richard Feller, Okton, VA (US)

( * ) Notice: Subject to any disclaimer, the term of this patent is extended or adjusted under 35 U.S.C. 154(b) by 1519 days.

(21) Appl. No.: 11/229,523

(22) Filed: Sep. 20, 2005

(65) Prior Publication Data

US 2007/0069473 A1 Mar. 29, 2007

(51) Int. Cl.
*G09B 19/00* (2006.01)

(52) U.S. Cl. ..... 434/236

(58) Field of Classification Search ..... 463/1, 9, 463/40–42; 273/236, 237, 296, 302, 429–432; 434/185, 236–238, 322
See application file for complete search history.

(56) References Cited

U.S. PATENT DOCUMENTS 5,375,846 A * 12/1994 Smith ..... 273/292
5,746,433 A * 5/1998 Klassen et al. ..... 273/302
6,422,558 B1 * 7/2002 Chambers ..... 273/146
6,464,222 B1 * 10/2002 Parker ..... 273/236
6,618,723 B1 9/2003 Smith
6,715,762 B2 * 4/2004 Simmons ..... 273/429
6,735,568 B1 * 5/2004 Buckwalter et al. ..... 705/1
6,976,916 B2 * 12/2005 Burrell et al. ..... 463/1
7,073,792 B2 * 7/2006 Esposito ..... 273/243
7,213,206 B2 * 5/2007 Fogg ..... 715/706
2004/0166915 A1 * 8/2004 Robarge ..... 463/9
2006/0216680 A1 * 9/2006 Buckwalter et al. ..... 434/236
2006/0282426 A1 * 12/2006 Spears ..... 707/5

* cited by examiner

*Primary Examiner* — Dmitry Suhol
*Assistant Examiner* — Jay Trent Liddle
(74) *Attorney, Agent, or Firm* — McGinn IP Law Group, PLLC

(57) ABSTRACT

A method (and process and system) for improving interpersonal communication between a plurality of parties, includes directing a party in the plurality of parties to discuss a subject from a plurality of subjects with at least one other party in the plurality of parties for at least a predetermined period of time, the plurality of subjects including an emotional component and an intellectual component, and discussing the subject by the party.

15 Claims, 7 Drawing Sheets

200

| | | RESPONSE | CATEGORY | | | | | |
|---|---|---|---|---|---|---|---|---|
| | | | A | B | C | D | E | F |
| QUESTION | 1 | C | +5 | 0 | 0 | +2 | -1 | 0 |
| | 2 | A | | | | | | |
| | 3 | D | | | | | | |
| | 4 | A | | | | | | |
| | 5 | B | | | | | | |
| | 6 | C | | | | | | |
| | 7 | A | | | | | | |

400

FIG.4

| | | RESPONSES | | CATEGORY | | | | | |
|---|---|---|---|---|---|---|---|---|---|
| | | PARTY 1 | PARTY 2 | A | B | C | D | E | F |
| QUESTION | 1 | C | C | +10 | 0 | 0 | +4 | -2 | 0 |
| | 2 | A | | | | | | | |
| | 3 | D | | | | | | | |
| | 4 | A | | | | | | | |
| | 5 | B | | | | | | | |
| | 6 | C | | | | | | | |
| | 7 | A | | | | | | | |
| TOTAL CATEGORY SCORES | | | | | | | | | |
| OVERALL SCORE | | | | | | | | | |

500

FIG.5

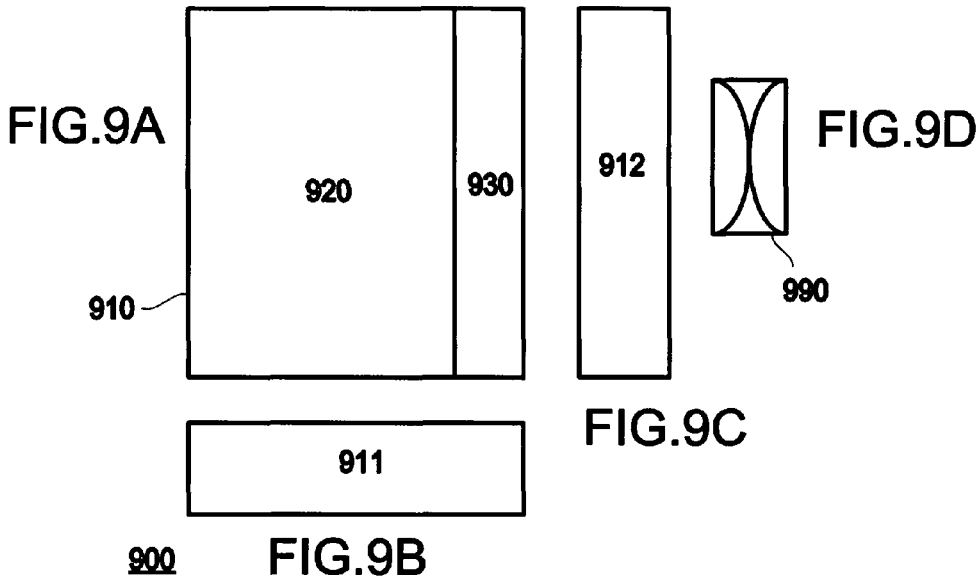
FIG.9A
920
930
910
912
FIG.9D
990
FIG.9C
911
900
FIG.9B
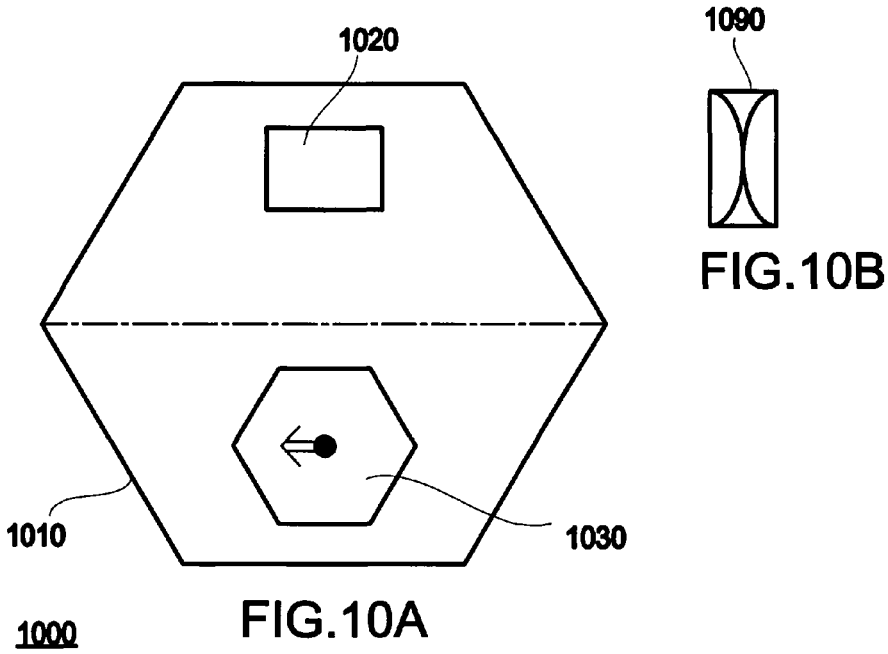
1020
1090
FIG.10B
1010
1030
1000
FIG.10A

1118
W
SIDE VIEW 1116
1114
1112
1119
L 1102
1170
1170a
1170b
1105
1104d
SHUFFLE
GIVE ME 3 MORE MINUTES
1104j
1104k
AUTOMATIC QUESTION
1101
1110
1104a
START
1104b
STOP
1104c
PAUSE
1104
1104e
1104f
1104g
1104h
1104i
NEXT QUESTION
PREVIOUS QUESTION
UP MENU SELECTION
DOWN MENU SELECTION
1100

1170
1160
1150
1140
1110

METHOD AND SYSTEM FOR IMPROVING INTERPERSONAL COMMUNICATION

BACKGROUND OF THE INVENTION

1. Field of the Invention

The present invention relates to a method, process and system for improving interpersonal communication and, more particularly, to a method and system for improving interpersonal communication which may be used to improve a relationship between parties (e.g., husband and wife, a couple engaged to be wed, a dating couple, non-married companions, individuals who are in the process of building or maintaining a relationship, parent and child, employee(s) and employer, etc.) and, thereby help to avoid future breaks or separations between the parties.

2. Description of the Related Art

Poor interpersonal communication often leads to separation between parties. For example, approximately 50% of all marriages in the United States are currently ending in divorce. The biggest single factor, which has been identified as the underlying factor behind this incredibly high divorce rate, is a communication problem between the two partners.

Additional key factors which may play a role in causing divorce include financial problems, lack of commitment to the marriage, a dramatic change in priorities, sexual conflicts, and infidelity. Interestingly, communication, or lack of effective communication, is a common thread present within each of these key factors that have been prominently mentioned in marriage counseling or in divorce proceedings.

In addition, there are distinct differences in how men and women think, respond emotionally, and communicate their experiences to others. Such differences can often make communication between men and women difficult and can often leads to separation between parties.

Importantly, the majority of individuals in our society have never been taught how to effectively communicate with one another. Accordingly, at a time when communication is even more necessary than ever before, communication skills are failing to act as a catalyst to help draw the parties (e.g., husband and wife, a couple engaged to be wed, a dating couple, non-married companions, individuals who are in the process of building or maintaining a relationship, parent and child, employee(s) and employer, etc.) closer together. As a result, the parties drift apart, and the inevitable separation (e.g., divorce) occurs.

SUMMARY OF THE INVENTION

In view of the foregoing and other exemplary problems, disadvantages, and drawbacks of the aforementioned conventional systems and methods, it is a purpose of the exemplary aspects of the present invention to provide a method and system for improving interpersonal communication which may be used to improve a relationship between parties (e.g., husband and wife) and, thereby help to avoid future breaks or separations between the parties.

The exemplary aspects of the present invention include a method for improving interpersonal communication between a plurality of parties. The method includes directing a party (e.g., at least one party) in the plurality of parties to discuss a subject from a plurality of subjects with at least one other party in the plurality of parties for at least a predetermined period of time, the plurality of subjects including an emotional component and an intellectual component, and discussing the subject by the party.

The exemplary aspects of the present invention also include a system for improving interpersonal communication between a plurality of parties. The system includes a device for directing a party in the plurality of parties to discuss a subject from a plurality of subjects with at least one other party in the plurality of parties for at least a predetermined period of time, the plurality of subjects comprising an emotional component and an intellectual component.

The exemplary aspects of the present invention also include programmable storage medium tangibly embodying a program of machine-readable instructions executable by a digital processing apparatus to perform the method of improving interpersonal communication between parties according to the exemplary aspects of the present invention.

With its unique and novel features, the claimed invention provides a method, process and system for improving interpersonal communication which may be used to improve a relationship between parties (e.g., husband and wife, a couple engaged to be wed, a dating couple, non-married companions, individuals who are in the process of building or maintaining a relationship, parent and child, employee(s) and employer, etc.) and, thereby help to avoid future breaks or separations between the parties.

BRIEF DESCRIPTION OF THE DRAWINGS

The foregoing and other exemplary purposes, features, aspects and advantages will be better understood from the following detailed description of the exemplary embodiments of the invention with reference to the drawings, in which:

FIG. 4 illustrates a individual communication matrix 400 which may be generated by a website in a system for improving interpersonal communication according to the exemplary aspects of the present invention;

FIG. 5 illustrates a relationship profile matrix 500 which may be generated by a website in a system for improving interpersonal communication according to the exemplary aspects of the present invention;

FIGS. 9A-9D illustrate a system 900 for improving interpersonal communication according to the exemplary aspects of the present invention;

FIGS. 10A-10B illustrate a system 1000 for improving interpersonal communication according to the exemplary aspects of the present invention.

DETAILED DESCRIPTION OF THE EXEMPLARY EMBODIMENTS OF THE INVENTION

Figure 1:
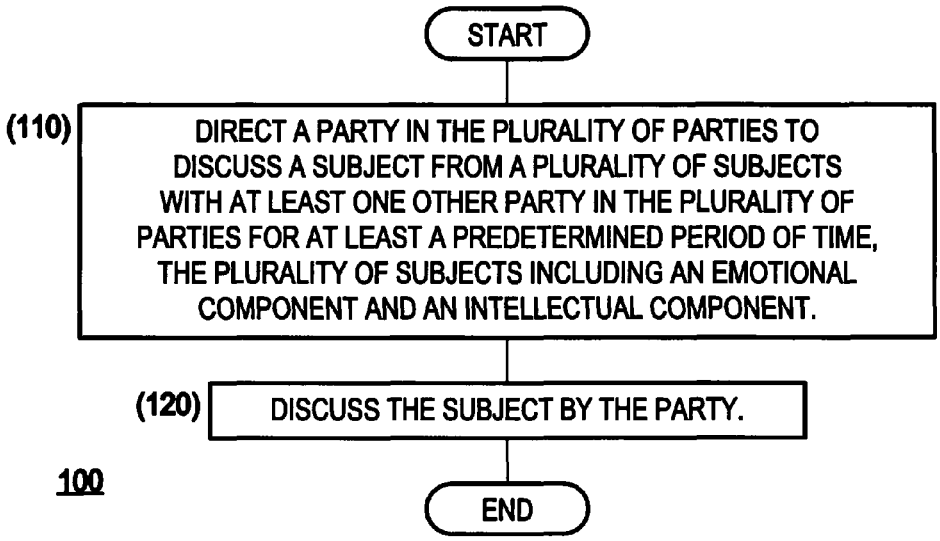
FIG. 1 illustrates a method 100 of improving interpersonal communication in accordance with the exemplary aspects of the present invention.

Referring now to the drawings, FIGS. 1-11D illustrate the exemplary aspects of the present invention.

Overview

The inventor has developed a novel method, process and system for improving interpersonal communication. In an exemplary aspect of the present invention, a deck of cards (e.g., a deck of communication cards) may be used to direct a party (e.g., a plurality of parties) to discuss with another party (e.g., plurality of parties), a subject for the purpose of improving interpersonal communication between the parties.

The inventor spent countless hours in marriage counseling sessions and/or with individuals in private therapeutic consultations, and in the process, identified some key discoveries. First, the inventor discovered that effective communication between parties (e.g., husband and wife, companions, etc.) is an absolute mandate if a relationship is to become and remain successful. Secondly, the inventor discovered that the vast majority of people (e.g., couples), regardless of ethnic or religious backgrounds, do not currently possess the knowledge/skills associated with knowing how to effectively communicate with their partner. As a result, these parties (e.g., couples) do not use effective communication skills to strengthen and enhance the relationship.

The inventor also discovered a novel manner of improving interpersonal communication. In an exemplary aspect, a deck of communication cards may be used to strengthen the relationship (e.g., "avoid the break") between parties (e.g., husband and wife, a couple engaged to be wed, a dating couple, non-married companions, individuals who are in the process of building or maintaining a relationship, parent and child, employee(s) and employer, etc.). The present invention may also be especially beneficial to a parties who presently have good communication skills, but desire a further enhancement of those skills, parties who have lost of suffer some diminishment in their bond of communication and desire to regain the bond, and parties who are currently contemplating separation or divorce.

It should be noted that although the present invention may be discussed herein generally as applying to couples, the present invention may also be designed for use by groups such as families, business entities, and other organizations which seek to improve their interpersonal communication and thereby improve their relationship amongst their members. For example, a family which has suffered some diminishment in communication among its members would likely find the present invention helpful.

Exemplary Aspects

As illustrated in FIG. 1, the exemplary aspects of the present invention include a method 100 for improving interpersonal communication between a plurality of parties. It should be noted that the term "interpersonal communication" may be construed to mean communication of any form (e.g., written, oral, sign language, facial expressions, body language, physical interaction, etc.) between more than one person.

The method 100 includes directing (110) a party in a plurality of parties to discuss a subject from a plurality of subjects with at least one other party in the plurality of parties for at least a predetermined period of time, the plurality of subjects including an emotional component and an intellectual component, and discussing (120) the subject by the party. The method 100 may be performed, for example, in conjunction with a consultative therapy session.

Further, the plurality of subjects may include, for example, financial issues between the plurality of parties, changes in priorities between the plurality of parties, sexual issues between the plurality of parties, etc.

In addition, the method 100 may also include providing a deck of playing cards which includes indicia (e.g., words, letters, numbers, pictures, etc.) indicating the subject to be discussed by the party. In this case, directing the party may include selecting a card from the deck of playing cards. That is, a party may select a playing card and reading indicia on the playing card which directs the party to discuss a subject.

The method may also include developing a relationship profile for the party and at least one other party. For example, developing the relationship profile may include directing the party and the at least one other party to answer preliminary questions. For example, the questions may be provided as a questionnaire to the parties.

The method 100 may also include analyzing the relationship profile to identify a source of weakness in a communication relationship between the party and the at least one other party. This would allow the plurality of subjects to be based on (e.g., focus on) the identified weaknesses.

The method 100 may also include after the discussing the subject by the party, providing feedback to the party regarding a discussion of the subject by the party. The method 100 may also include after the discussing the subject by the party, discussing the subject by the at least one other party.

The method 100 may further include after the discussing the subject by the party, directing the at least one other party to discuss another subject from the plurality of subjects with the party for at least a predetermined period of time, and discussing the another subject by the at least one other party. Further, the method 100 may include alternately repeating the directing of the party to discuss the subject, and the directing the at least one other party to discuss the another subject.

The method 100 may also include after the alternately repeating the directing the party to discuss the subject, and the directing the at least one other party to discuss the another subject, directing the party to discuss a communication relationship with the other party generally.

In addition, directing (110) the party may include using a video device which is played back to generate a display comprising indicia including directions for directing the party to discuss the subject. Further, directing (110) the party may also include using an audio device which is played back to generate audio directions for directing the party to discuss the subject. Directing (110) the party may also include using a board game. For example, the board game may include a board, a plurality of game pieces, and a plurality of cards comprising indicia including directions for directing the party to discuss the subject (e.g., and move a game piece on the board according to predetermined rules for conducting the board game).

Figure 2:
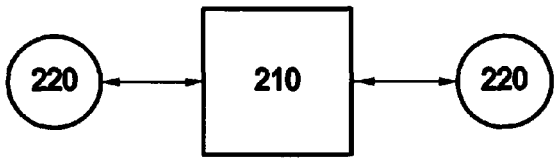
FIG. 2 illustrates a device 200 for improving interpersonal communication in accordance with the exemplary aspects of the present invention.

Referring again to the drawings, FIG. 2 illustrates a system 200 for improving interpersonal communication between a plurality of parties. The system 200 includes a device 210 for directing a party in the plurality of parties 220 to discuss a subject from a plurality of subjects with at least one other party in the plurality of parties for at least a predetermined period of time, the plurality of subjects including an emotional component and an intellectual component. The device 210 may include, for example, one of a deck of playing cards, a board game, a personal computer, an Internet website, a video device and an audio device.

The system 200 may also include a feedback device which is usable by the at least one other party to provide feedback to the party regarding a discussion of the subject by the party. The system 200 may also include a device (e.g., a written questionnaire) for developing a relationship profile for the party and the at least one other party.

For example, the system 200 may also include a computer-implemented system which includes a database for storing the plurality of subjects. Alternatively, the database may be remote to the system 200 but accessible (e.g., via a network such as the Internet) by the device 210. The computer-implemented system may also include processor which may be used, for example, to develop the relationship profile between the parties, to analyze the relationship profile to identify a source of weakness in a communication relationship between the party and the at least one other party, and select the plurality of subjects based on said identified weaknesses.

Further, the device 210 may include a video device (e.g., a television or computer monitor and a digital video disc, VCR tape, CD-ROM, etc. for use therein) which is played back to generate a display including indicia for providing directions for directing the party to discuss the subject with at least one other party. The device 210 may also include an audio device (e.g., an audio player (e.g., compact disc player, cassette tape player, etc. and an audio tape, compact disc, etc. for use therein) which is played back to generate audio directions for directing the party to discuss the subject with the at least one other party.

The system 200 may also include a computer-implemented system. In this case, the device 210 may include a personal computer for operating software for performing the method (e.g., method 100) according to the exemplary aspects of the present invention. That is, the software may include a programmable storage medium tangibly embodying a program of machine-readable instructions executable by a digital processing apparatus to perform a method of improving interpersonal communication between a plurality of parties.

Internet-Based System

The system of the present invention may also be implemented using a communication medium which includes a network of interconnected user terminals such as the Internet (e.g., a global network of computers), in which routers move an information packet between network levels, and from network to network, until it reaches the appropriate user terminal. The network includes routing hubs having domain name system (DNS) servers using Transmission Control Protocol/Internet Protocol (TCP/IP), and connecting one or more other routing hubs via high speed communication links.

Specifically, the system may be implemented as a website on the World Wide Web (WWW) which is supported by the Internet. The website may include a computer (e.g., server) for storing documents and generating a display on a user terminal which displays graphical and textual information. The website may be defined by an Internet address that has an associated electronic page (e.g., a document that organizes the presentation of text, graphics, images, audio, video, etc.) which is identified by a Uniform Resource Locator (URL).

Figure 3:
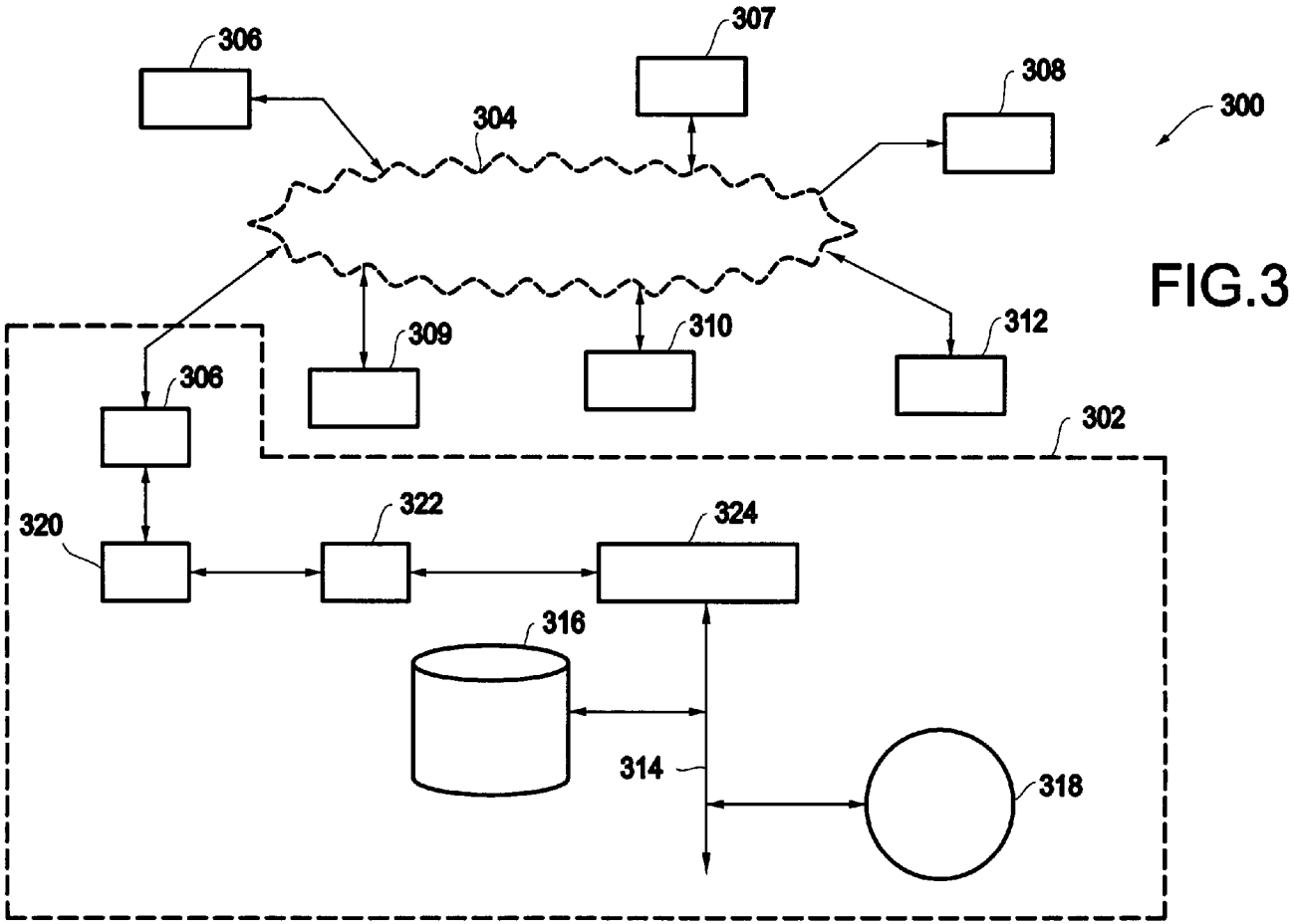
FIG. 3 illustrates a system 300 (e.g., Internet-based system) for improving interpersonal communication according to the exemplary aspects of the present invention.

FIG. 3 illustrates a system 300 (e.g., Internet-based system) according to the exemplary aspects of the present invention. The system 300 includes a webserver 302 (e.g., website) connected to the Internet 304 and a plurality of user terminals 306-312 (e.g., for a client, customer, etc.). The user terminals 306-312 may include a personal computer (e.g., desktop, notebook, etc.) having a display device, input device (e.g., keyboard, mouse, etc.), memory (e.g., RAM, ROM, etc.) which may store a web browser (e.g., Netscape Communicator, MICROSOFT ® Internet Explorer, etc.), and microprocessor which causes the user terminal to generate a display screen (e.g., graphical user interface (GUI)) on the display device.

The webserver 302 may include a network interface controller (NIC) 306 for interfacing with the network Internet 304. The webserver 302 may also include an interactive webpage user interface 320 (e.g., MICROSOFT ® Active Server Pages (ASP)), and an Internet file and application server 322 (e.g., MICROSOFT® Internet Information Server (IIS)), that runs under control of an operating system 324 (e.g., MICROSOFT® Windows-NT server). The interface 320 and server 322 may together generate a web presence on the Internet.

The webserver 302 may also include an expansion bus 314 which supports a database 316 and a general purpose storage disk 318 for storing various programs (e.g., Microsoft® Windows-NT services such as Microsoft® SQL Server, Microsoft® Exchange Server, Dynamic Host Interface Protocol (DHCP), and Windows Internet Name Service (WINS) servers) for supporting the website.

For example, to participate in an online game according to the exemplary aspects of the present invention, a user may "visit" the website by opening a web browser application on a user terminal, and entering the URL corresponding to the website. This may cause the website to generate a first (e.g., introduction) screen to be displayed on a display of the user terminal of the user. This screen may allow the parties to play from the same user terminal on the Internet, or on separate terminals. This would allow parties to participate together from remote locations.

The first screen may direct the parties to enter personal information such as the parties' names and passwords for accessing their personal information. This personal information may also be stored in the website memory for future reference. Thus, when the party returns to play at a later date, the personal information entry step may be bypassed.

Upon entering the personal information on the first page, the website may generate a questionnaire screen which directs the parties to provide answers to preliminary questions. This screen may also request that the parties identify the nature of the relationship between the parties (e.g., husband/wife, employer/employee, parent/child, etc.), and may request that the parties input other personal information (e.g., gender, age, race, etc.).

The website may also select a questionnaire for the parties based on the nature of the relationship input on this screen, and/or based on the other personal information input by the parties. That is, the questionnaire may include questions which focus on the nature of the relationship between the parties, and which may be specifically tailored based on the other personal information of the parties. The website may store the answers to the preliminary questions and develop a relationship profile for the parties based on the answers.

To develop a relationship profile, the website may score the answers of the parties (e.g., each of the parties) to each of the questions in several categories. These scores may be stored in the website database in the form of an individual communication matrix 400 as illustrated, for example, in FIG. 4. That is, the website may generate and store an individual communication matrix 400 for a party answering the questionnaire on the questionnaire screen.

In addition, the website may store a matrix 400 for a plurality of questionnaires. That is, for a given respondent, the website may store a spousal individual communication matrix pertaining to husband/wife issues, an employment individual communication matrix pertaining to employer/employee issues, a family individual communication matrix pertaining to parent/child issues, and so on.

The Categories in the matrix 400 may include categories of important subject matter which have been identified as important to improving communication between the parties. For example, Category A may be Religious Issues, Category B may be Family Issues, etc. The Categories, like the questions in the questionnaire, may be different depending upon the nature of the relationship under examination (e.g., spousal, employer/employee, parent/child, etc.). The website may store a score in these categories which correlates to the response to the question. For example, where the response to question 1 (e.g., a multiple choice question) was "C", then the score stored in the website for Category A may be +5. The response to question 1 may or may not affect a score in other categories. For example, in the matrix 400, the response of "C" to question 1 resulted in a score in Category D of +2, and in Category E or −1, but had no effect on the scores in Categories B, C and F.

As an example, the scores attributed to the responses may be representative of the respondent's willingness and/or ability to communicate with respect to the issues represented by that category. Thus, for example, a lower score in a particular category may indicate that the respondent might want to focus on improving his willingness and/or ability to communicate with respect to the issues represented by that category. For example, as illustrated in the exemplary aspect of FIG. 3, the scores may be based on a scale from −5 representing "least communicative" to +5 representing "most communicative" in the respective category.

After generating the individual communication matrix 400, the website may then generate a display directing the parties enter a command for generating a relationship profile between the two or more parties. When entered, this command causes the website to use (e.g., combine) the individual communication matrices 400 for the parties to generate a relationship profile matrix 500 as illustrated in FIG. 5. For example, as illustrated in FIG. 5, assuming that Party 1 and Party 2 both responded to question 1 with "C", the individual scores in Categories A, D and E (e.g., +5, +2 and −1) for the parties may be summed to generate "relationship scores" (e.g., +10, +4 and −2) in these categories for the respective questions.

The matrix 500 may also include the total category scores for the categories. This total score for a category may be obtained, for example, by summing the individual scores for the questions in the category. In addition, the individual scores in a category may be weighted to reflect a particular importance of a question or response. Such importance may be standard in the system or may be input to the system by one of the parties.

For example, the website may ask a party to indicate (e.g., in responding to the preliminary questions) when a question pertains to subject matter that is particularly important to that party. When such importance is indicated by the party, the individual score for that question may be weighted by increasing (e.g., doubling, tripling, etc.) that score, before calculating a total score for a category.

The matrix 500 may also include an overall score which may be obtained by summing the total category scores and may also reflect a weighting of an particular total score in a category to reflect a particular importance of that category. As with the weighting of the questions above, such importance may be standard in the system or may be input to the system by one of the parties. For example, the website may ask a party to indicate when a category pertains to subject matter that is particularly important to that party. When such importance is indicated by the party, the total score for that category may be weighted by increasing (e.g., doubling, tripling, etc.) that score, before calculating the overall relationship score.

The website may store this relationship profile matrix 500 for the parties. The parties may then access their matrix in order to resume play at a later time, or to maintain an ongoing game over several weeks, months or years, etc.

The website may then analyze the relationship profile matrix 500 for the parties to identify weaknesses in a communication relationship between the parties, and may select (e.g., generate) a plurality of subjects for discussion in the areas of the identified weaknesses.

The website may then generate a display directing a party in the plurality of parties to discuss a subject from the plurality of subjects with at least one other party in the plurality of parties for at least a predetermined period of time (e.g., 3 minutes). The subjects may be randomly selected by the website and may be focused on particular areas based, for example, on the nature of the relationship, the relationship profile for the parties, and the other personal information input by the parties.

The display may allow the users to input a time limit, and may display a clock (e.g., digital display) on an area of the screen which counts down the time remaining. The selected party may discuss subject for the determined time period.

After discussing the subject by the party (e.g., after the time for discussion has elapsed), the website may cause a display to be generated (e.g., automatically generated) which directs another party to provide some feedback to the discussing party regarding his discussion of the subject. This display may also include an area for allowing the other party to input his feedback in the form of alphabetical or numerical rating. For example, the display may read "Rate the discussion for candor on a scale of 1 to 10", "Rate the discussion for willingness to communicate on that particular subject on a scale of 1 to 10", and so forth. The website may use the feedback to update (e.g., continuously update) the individual communication matrix for the discussing party and/or the relationship profile matrix for the parties.

After the other party enters the feedback information, the website may then generate a display directing the other party to discuss another subject which may be the same or different from the first subject. After the discussion, and after the feedback has been entered, the first party is again directed to discuss another subject and so on, until several of the subjects have been discussed by the parties.

At any time during the game, the players may be allowed to view the total scores from their relationship profile matrix 500. This may allow the parties to see an improvement in the interpersonal communication between the parties. For example, as they witness their total scores increase, the parties may be encouraged by the notion that their communication is improving. In addition, the website (e.g., upon the end of play) may generate a display which, based on the total scores from the relationship profile matrix 500, compliments the parties in the categories in which their scores are high, and which includes recommendations for improving their communication in the categories in which their scores are low.

Figure 6:
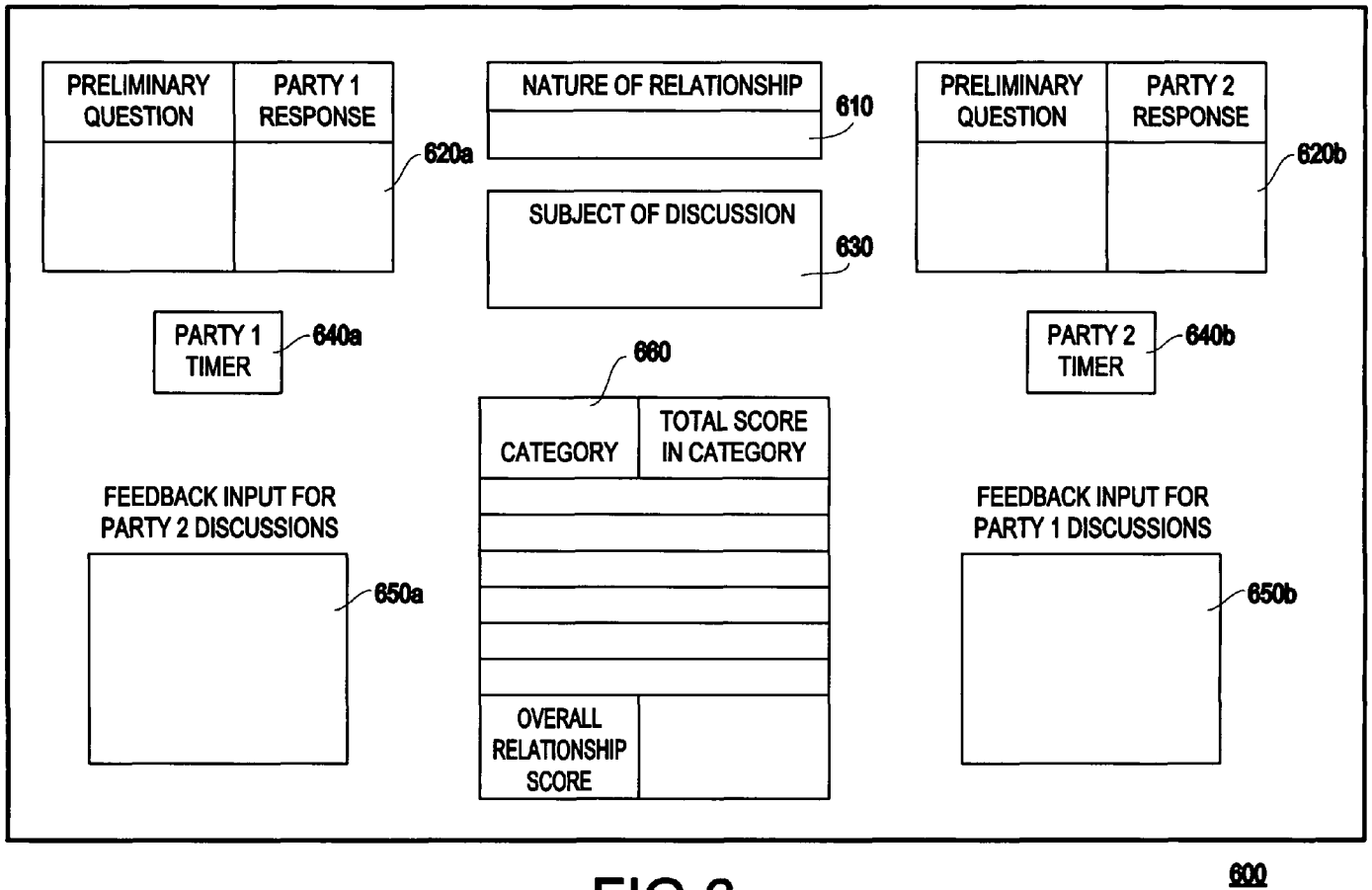
FIG. 6 illustrates a display screen 600 (e.g., view, screenshot, etc.) which may be generated by a website in a system for improving interpersonal communication according to the exemplary aspects of the present invention.

Further, the website may generate a display which may incorporate the several displays discussed above, in a unique and efficient design for playing a communication game according to the exemplary aspects of the present invention. For example, FIG. 6 illustrates a display screen 600 (e.g, graphical user interface (GUI)) which may be generated by the website. As illustrated in FIG. 6, the screen 600 may include a region 610 for inputting the nature of the relationship, and regions 620*a*, 620*b* for displaying preliminary questions and inputting responses to the questions for Parties 1 and 2, respectively. The screen 600 may also include a main display region 630 for displaying the subject of discussion, timers 640*a*, 640*b* which display a time remaining for discussion for Parties 1 and 2, respectively, and areas 650*a*, 650*b* for displaying feedback questions and for inputting responses to the feedback questions for discussions by Parties 2 and 1, respectively.

The screen 600 also includes an area 660 for displaying the total category scores and the overall relationship score from the relationship profile matrix 500. This area 660 may be updated upon the input of feedback by one of the parties. Such updating will allow the parties to easily monitor their progress in improving their interpersonal communication.

Additional Aspects

Two or more participants (e.g., two or more couples) can use the present invention at the same time. Further, in an exemplary aspect, the present invention may be used as a game (e.g., card game, board game, video game, computer game, etc.) to entertain users.

The invention may effectively be utilized (e.g., by couples, families, etc.) as a form of self-therapy. The invention may also be used with the use of a professional in conjunction with consultative therapy. That is, the present invention may be considered a useful tool in marriage counseling, family counseling, psychiatric, psychological counseling sessions.

In an exemplary aspect of the present invention, a user (e.g., one of the participants in a communication card game) may draw the top card from the upside down deck. This participant may read the card aloud. Some subjects (e.g., questions) may be simple while others may be intentionally difficult to answer. Some questions may require a good deal of thought by the participant while other cards may be readily answerable since the participant may have already spent time thinking about the identified subject area.

Collectively, the cards may include questions (e.g., directions to discuss a particular subject matter), which are of both an emotional and intellectual nature. For example, an emotional aspect would be intended to evoke an emotion (e.g., love, hate, etc.) in the party reading the card. An intellectual aspect would be intended to cause an engagement of the intellect (e.g., analytical reasoning, logical reasoning, etc.) of the party reading the card.

For example, for a parent/child relationship, the subjects may include an emotional component such as, "Discuss how you feel when your child violates the 9:00 P.M. curfew", and an intellectual component "Discuss how you feel about your child having a personal checking account". Similarly, for an employer/employee relationship, the subjects may include an emotional component such as, "Discuss how you feel about not being invited to lunch with co-workers", and an intellectual component "Discuss how you feel when your learn a new process which is important to the business".

In addition, the cards could be directed to parties based on a known "weakness" or based on data indicating a increased likelihood for a certain "weakness". For example, cards with an emotional component could be directed to men who may be more likely to have a "weakness" in communication regarding emotional subject matter, whereas cards with an analytical (e.g., intellectual) component may be directed to women who may be more likely to have a "weakness" in communication regarding analytical subject matter.

Human beings are both intellectual and emotional, and the integration of both attributes is wisdom. Effective communication is required to assist each participant to bridge the gap between the emotions (e.g., which may be a more natural state for the female) and the intellect (e.g., which may be a more natural state for the male).

As the gulf between emotions and intellect is bridged, individual awareness is enhanced, trust is deepened, and sharing and communication at increasingly deeper levels develops. Correspondingly, the communication relationship between the parties grows (e.g., interpersonal communication between the parties is improved). As it does, a relationship between the parties (e.g., a relationship based on love) may be greatly expanded, helping to avoid future breaks or separations between the parties.

Specifically, the cards in the exemplary aspect discussed above may contain questions that parallel those areas which have been identified as the key factors underlying divorce or separation. For example, since divorce or separation is commonly linked to financial problems, changes in priorities, sexual conflicts and other emotional or intellectual issues, these issues may be used by the present invention as subjects for discussion. Questions on the cards may also be focused on assisting the parties to communicate on subjects that the parties may feel uncomfortable discussing, or subjects that the parties would avoid discussing, or if the subjects are discussed, the subjects are given only slight attention and not effectively discussed.

In an exemplary aspect, a user of the present invention (e.g., a participant in a communication game) may be asked to take a specified amount of time (e.g., no less than approximately three minutes) to discuss a subject (e.g., answer a question pertaining to a subject). By specifying a time period for discussion, "yes" and "no" answers may be avoided. Further, such a "discussion" format helps to facilitate (e.g., simultaneously) the use of emotions or feelings, in addition to the use of pure logic (e.g., intellect). Ground-rules may include sensitivity and respect to the party that is discussing the subject (e.g., answering the question).

Another party (e.g., the husband or wife of the discussing party) may be asked to give his or her honest response or feedback to the discussing party (e.g., the party who answered the question). In addition, the other party may answer the same question. Thereafter, the card may be placed at the bottom of the pile so it cannot be used again until all other cards have been drawn.

Further, as part of the present invention (e.g., at the end of the evening or session) the parties may be asked to reflect on the discussions between the parties (e.g., to answer at least one reflective question). For example, the parties may be asked to discuss for at least a predetermined time (e.g., about 3 minutes), (1) how the party feels that he or she did in terms of the communication process of talking/sharing one with the other (e.g., how openly the party was in expressing his or her feelings); (2) how could the party have communicated or shared more effectively with the other party (e.g., their partner) or parties); (3) what will the party do differently in the future to further improve his or her communication with the other party or parties, etc.

These discussions may be used to further guide a later portion (e.g., Part 2) of the game. For example, in a subsequent game or portion of the game, the questions may be altered to focus more directly on a particular subject matter (e.g., a party's communication skills regarding financial matters). Thus, these responses may be used to refine the communication improvement process being facilitated by the game.

In addition, in another aspect of the present invention, a party may be allowed to cull through the questions to select questions that are most relevant to that party. For example, if a party is seeking a potential spouse, the questions most relevant to that party may be questions pertaining to a spousal relationship, such as financial matters, sexual matters, etc. The party may then direct these most relevant questions to a potential spouse in order to improve communications with the potential spouse.

Another aspect may include the use of a "board" similar to those used in a board game (e.g., MONOPOLY®, RISK®, etc.). For example, the cards can also be used within a board game where a participant rolls a set of dice and moves "x" number of spaces. When the participant lands on a certain space, the participant draws a card on a given subject area such as financial problems, or changes in priorities, or sexual conflicts. In turn, the participant may draw a card in that category and then answers it out loud, and may put the card on the bottom of the deck when the participant finishes discussing the card.

Another aspect may include the use of a "spinner device", whereby the participant spins the needle. The needle, when it finishes spinning, points out a certain card pile where the participant spinner is to draw and answer the top card in that category out loud. The card may then be placed on the bottom of that deck of cards.

Another aspect of the present invention may include a computer-implemented system and method for improving interpersonal communication. That is, based upon the need of participants, the communication process may be expanded to include computer (e.g., software) applications. This aspect is particularly helpful for allowing users to have the opportunity to participate in survey questionnaires on a web site. This will include particular areas of communication interest where the participant has the most need. In turn, these areas of communication will be strengthened through select methods of interpersonal communication.

Figures 7, 8:
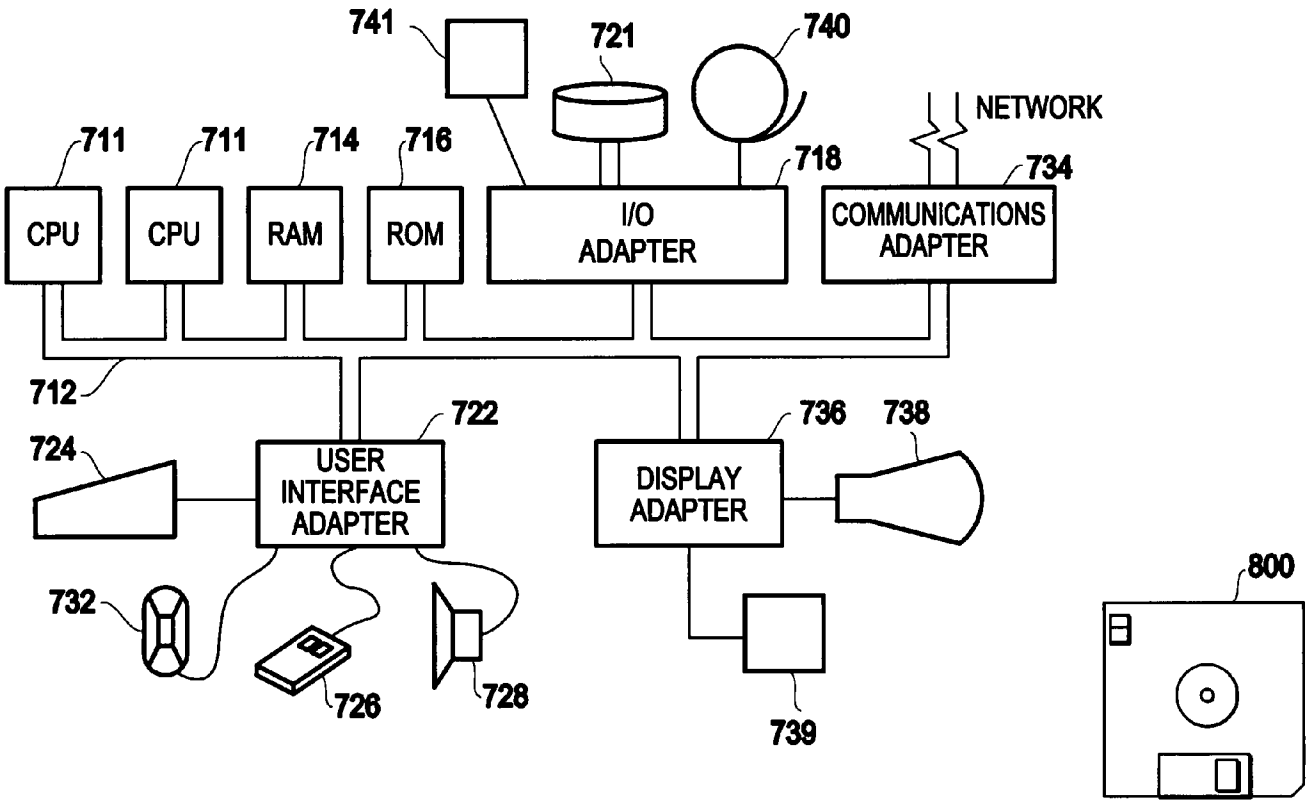
FIG. 7 illustrates a typical hardware configuration 700 which may be used for implementing the inventive method and system according to the exemplary aspects of the present invention.
FIG. 8 illustrates a programmable storage medium 800 which tangibly embodies a program of machine-readable instructions executable by a digital processing apparatus to perform a method of improving interpersonal communication between a plurality of parties.

Referring again to the drawings, FIG. 7 illustrates a typical hardware configuration 700 which may be used for implementing the inventive method and system according to the exemplary aspects of the present invention. The configuration has preferably at least one processor or central processing unit (CPU) 711. The CPUs 711 are interconnected via a system bus 712 to a random access memory (RAM) 714, read-only memory (ROM) 716, input/output (I/O) adapter 718 (for connecting peripheral devices such as disk units 721 and tape drives 740 to the bus 712), user interface adapter 722 (for connecting a keyboard 724, mouse 726, speaker 728, microphone 732, and/or other user interface device to the bus 712), a communication adapter 734 for connecting an information handling system to a data processing network, the Internet, and Intranet, a personal area network (PAN), etc., and a display adapter 736 for connecting the bus 712 to a display device 738 and/or printer 739. Further, an automated reader/scanner 741 may be included. Such readers/scanners are commercially available from many sources.

In addition to the system described above, a different aspect of the invention includes a computer-implemented method for performing the above method. As an example, this method may be implemented in the particular environment discussed above.

Such a method may be implemented, for example, by operating a computer, as embodied by a digital data processing apparatus, to execute a sequence of machine-readable instructions. These instructions may reside in various types of signal-bearing media.

Thus, this aspect of the present invention is directed to a programmed product, including signal-bearing media tangibly embodying a program of machine-readable instructions executable by a digital data processor to perform the above method.

Such a method may be implemented, for example, by operating the CPU 711 to execute a sequence of machine-readable instructions. These instructions may reside in various types of signal bearing media.

Thus, this aspect of the present invention is directed to a programmed product, comprising signal-bearing media tangibly embodying a program of machine-readable instructions executable by a digital data processor incorporating the CPU 711 and hardware above, to perform the method of the invention.

This signal-bearing media may include, for example, a RAM contained within the CPU 711, as represented by the fast-access storage for example. Alternatively, the instructions may be contained in another signal-bearing media, such as a magnetic data storage diskette 800 (FIG. 8), directly or indirectly accessible by the CPU 711.

Whether contained in the computer server/CPU 711, or elsewhere, the instructions may be stored on a variety of machine-readable data storage media, such as DASD storage (e.g, a conventional "hard drive" or a RAID array), magnetic tape, electronic read-only memory (e.g., ROM, EPROM, or EEPROM), an optical storage device (e.g., CD-ROM, WORM, DVD, digital optical tape, etc.), paper "punch" cards, or other suitable signal-bearing media including transmission media such as digital and analog and communication links and wireless. In an illustrative embodiment of the invention, the machine-readable instructions may comprise software object code, complied from a language such as "C," etc.

Subjects for Discussion

The subjects for discussion in the present invention may include subjects (e.g., select questions) which are drawn from research on improving communication between parties (e.g., research on marital divorce and separation) domestically and/or internationally. In addition, the subjects may include input from counselors (e.g., marriage, school, etc.), therapists, etc. who may provide input regarding question construction related to findings within their respective practices.

Further, other professionals such as paid speakers, communication teachers at the high school and college/university level, business consultants, and medical personnel where applicable and appropriate, based upon their respective practices, may also provide input regarding the subjects (e.g., questions). Further, participants in the communication improvement process may modify the subjects (e.g., questions) based upon their own experience with the communication process, and/or to submit new questions based upon their personal interest and needs (e.g., via a website using a personal computer, etc.).

Examples of the subjects for discussion (e.g., the cards that may be included in a playing deck) include the following:

In three (3) minutes, discuss how you felt when you had your second child;

In three (3) minutes, discuss one thing that excites you about your companion;

In three (3) minutes, discuss how you felt when you met your companion for the first time;

What is the one thing that you would like to tell your companion but are afraid to tell him/her?;

Take three (3) minutes and discuss one thing that you truly love to do. Describe how you feel when you do it.

In three (3) minutes, discuss how you feel when your boss tells you that you succeeded at something;

In three (3) minutes, discuss how you feel when your boss tells you that you failed at something;

In three (3) minutes, discuss a situation when you are feeling the most self-confident;

In three (3) minutes, discuss how you feel when your husband buys you flowers;

In three (3) minutes, discuss how you felt when you learned that a person very close to you had died;

In three (3) minutes, discuss what excites you sexually;

In three (3) minutes, discuss how you feel when you believe that your world, or job, or marriage, . . . has gotten out of control. Select one area to discuss;

In three (3) minutes, discuss a "really exhilarating moment" that you have had;

Talk about your feelings toward your grandfather for three (3) minutes;

In three (3) minutes, discuss the most joyful thing that has ever happened to you;

Take three (3) minutes and discuss how you feel when you are sick or are in pain;

In three (3) minutes, describe how you feel when your companion tells you he/she loves you and really means it!;

In three (3) minutes, discuss how you feel when someone tells you that you have done something right;

In three (3) minutes, discuss how you feel when you feel really good about yourself and what situations make you feel really good about yourself;

In three (3) minutes, discuss what you most need to have your companion do for you that would really make you feel good;

Talk about your feelings toward your brother for 3 minutes;

In three (3) minutes, describe how you feel when you cry in front of someone that you value;

In three (3) minutes, discuss how you felt when you had your third child;

Spend three (3) minutes and discuss how you feel that your children detract from your "quality time" with your companion;

In three (3) minutes, discuss what would be your ideal evening with your wife;

In three (3) minutes, discuss how you feel when your companion spends money outside your budget;

In three (3) minutes, discuss how you feel when you listen to beautiful music;

In three (3) minutes, discuss how you feel about your job when everything is going bad;

In three (3) minutes, discuss how you feel when someone compliments you or praises you;

In three (3) minutes, discuss what your husband does that really makes you feel good physically;

In three (3) minutes, discuss how you feel about "good" or "evil", or if you believe in only one or the other or neither;

Talk about your feelings toward your uncle for three (3) minutes;

In three (3) minutes, discuss the most frightening thing that has ever happened to you;

What is the one thing that you would like to tell your husband but are afraid to tell him?

Take three (3) minutes and discuss how you feel when you travel or take a vacation;

In three (3) minutes, discuss how you feel about your job when everything is going well;

In three (3) minutes, discuss how you feel when someone criticizes you or "puts you" down;

In three (3) minutes, discuss how you feel about death and what you feel happens to you when you die;

In three (3) minutes, discuss what your companion does that really makes you feel good physically;

In three (3) minutes, discuss one thing that irritates you about your husband;

In three (3) minutes, describe how you feel about Jesus;

For husbands: How did you feel when you learned that your wife was pregnant?;

Talk about your feelings toward having or not having children in three (3) minutes;

In three (3) minutes, discuss how you feel about your children in comparison to your husband;

Talk about your feelings toward your mother for three (3) minutes;

In three (3) minutes, discuss what makes you the happiest;

In three (3) minutes, discuss how you felt when you met your wife for the first time;

Take three (3) minutes and discuss one thing that you truly detest doing. Describe how you feel when you do it;

In three (3) minutes, describe how you feel when your wife tells you that she loves you and really means it!;

In three (3) minutes, discuss how you feel when someone tells you that you have done something wrong;

In three (3) minutes, discuss how you feel inadequate and what situations make you feel inadequate;

In three (3) minutes, discuss what you most need to have your wife do for you that would really make you feel good;

In three (3) minutes, discuss what would be a horrible evening with your companion;

In three (3) minutes, discuss one thing that you have never shared with your companion;

In three (3) minutes, discuss how you feel about personal hygiene and how your companion could improve their personal hygiene.

In three (3) minutes, discuss how you felt on your wedding day;

In three (3) minutes, discuss how you feel about your children in comparison to your wife;

In three (3) minutes, discuss how you feel when you are lonely or are feeling lonely;

Talk about your feelings toward your father for three (3) minutes;

In three (3) minutes, discuss what is your greatest fear;

In three (3) minutes, discuss how did you feel when you found out that you were pregnant for the first time;

In three (3) minutes, discuss how you felt when you had your first child;

In three (3) minutes, discuss what would be your ideal evening with your husband;

Talk about your feelings toward your grandmother for three (3) minutes;

Talk about your feelings toward your sister for three (3) minutes;

In three (3) minutes, discuss how you feel when you speak in front of an audience;

In three (3) minutes, discuss how you feel when your husband spends money outside of your budget;

In three (3) minutes, discuss how you feel about God;

In three (3) minutes, discuss one thing that irritates you about your wife;

In three (3) minutes, discuss how you feel about continuing to learn and to grow;

In three (3) minutes, discuss how you feel when your boss tells you that you failed at something;

In three (3) minutes, discuss a situation in which you feel the most insecure;

In three (3) minutes, discuss how you feel when you get all dressed up and you know that you look good!;

In three (3) minutes, discuss a really embarrassing moment that you have had; and In three (3) minutes, discuss how you feel when you believe that you are in control.

In three (3) minutes, discuss how your companion could improve your sex life by 2 points on a scale of 1 to 10.

It should be noted that the above subjects (e.g., cards including the subjects) are intended to be examples and in no way should these examples be considered as limiting. That is, other subjects (e.g., cards) can be used with the present invention in addition to the subjects (e.g. cards) listed above.

Additional Aspects

The present invention may be implemented, for example, by using a televised program in which a panel of participants play a game or improving interpersonal communication according to the present invention. The program may also allow for people to call into the program to ask particular questions.

In addition, it should be noted that the present invention may be equally applicable and helpful across many different cultures (e.g., China, Iran, Europe, etc.).

The present invention may also be implemented, for example, in a game which may be called "Card Communication". The game "Card Communication" may be used, for example, by parties such as married couples during the marriage to open communication, and may also be used for premarriage situations when couples either want to find out if the other partner is the right person to advance the relationship.

The game "Card Communication" may also be used as a tool to assist in opening conversation for a shy or inexperienced party (e.g., companion, partner, etc.) to get answers to his or her question that he or she would not normally ask. By getting the answers to the questions or concerns may assist the party in deciding whether to choose to be just friends or take the relationship to another more serious level.

The game may include a 3 minute rule (e.g., responses should be given within 3 minutes) may be intended to add pressure on a party answering the question to answer with the first answer that comes into his or her mind. Thus, it will not give enough time to partner answering the question to make up a perfect (e.g., politically correct, socially correct, etc.) answer. Further, the game may include a 3 minute hourglass in order to create a visual effect of time running out. This may help to add pressure on the partner answering the question to answer it more honestly by giving the first answer that comes into his mind.

To better enhance all versions of Card Communication game, the game may be accompanied with the Internet website, as discussed above. The website Card Communication website may be used, for example, to provide an alternate way of ordering the games and more to provide additional information for the purchaser. The website may also provide a communication link between the organization and current customers, and allow customers to post questions and send inputs and suggestions. The input and suggestions will help with enhancing the later versions of the game.

In addition, the website may be used to generate revenue to support further enhancements and improvements in the game. For example, based on the number of hits on the website, an organization may get additional income from advertisement.

Further, the website may provide online Internet Chat capability for current customers to further enhance the Internet website. All online users will have the opportunity to discuss among themselves the answers that they have got previously from their partners with each other. By adding the chatting feature to the website, it will increase the number of hits on the website (beneficial for advertisement).

The website may also provide an opportunity to provide online consulting for current customers who need help with their relationships. Customers may be charged per incident or if live, per hour.

The website may also provide a mechanism for organizing members of an organization having a goal of improving interpersonal communication. Further, membership charges for members to access certain services may be charged and collected through the website.

The game may also be implemented in a software version of Card Communication which could be installed on a computer. The game may also include categorized to target specific relationship issues between parties (e.g., couples).

For example, the Card Communication game may be implemented according to the following exemplary aspects.

Card Communication Take Anywhere

FIGS. 9A-9D illustrate a system 900 which includes a "Take Anywhere Version of Card Communication" which is to provide an easy way for the user to carrying the Card Communication to any social gathering such as restaurants, bars, or parties. The system 900 may include a carrying card box 910 (e.g., see FIG. 9A) having a card location section 920 and section (e.g., slot) 930 for storing (e.g., securely storing) an hourglass (e.g., a 3 minute hourglass) 990 (e.g., see FIG. 9D). FIGS. 9B and 9C illustrate the width 911 and length 912 of the carrying card box, respectively.

The carrying box 910 may include (e.g., be made of) a high quality cardboard or plastic (e.g., polyethylene) box. The carrying box 910 may also be accompanied by a lid with printed logo.

Card Communication Board Game

FIGS. 10A-10B illustrate a system 1000 including a Card Communication Board Game which may allow for a group game. The system 1000 includes a game board 1010 which may include an area 1020 for locating cards for drawing during the game. The system 1000 may also include a spinner 1030 which may be separate from the game board 1010 or may be attached (e.g., integrally formed with, adhered with adhesive, etc.) to the board 1010. The spinner 1030 may include indicia (e.g., letters, words or numbers written around the outer perimeter of the spinner 1030) and may be used, for example, to determine which player should draw a card and answer the question thereon.

The system 1000 may also include an hourglass (e.g., 3 minute hourglass) for setting a time during which the question should be answered. The board 1010 may also include a fold line 1015 along which the game board 1010 may be folded for convenient storage.

The Card Communication Board Game may also be accompanied with a storage box with a logo printed on the lid.

Card Communication Electronic Version

FIGS. 11A-11D illustrate a system 1100 which includes a Card Communication Electronic version of the present invention. The system 1100 includes an electronic board 1110 having a power input port 1112 for connecting the board 1110 to a power supply, data input port 1114 (e.g., universal serial bus (USB), serial port, parallel port) for delivering data from a computer (e.g., personal desktop computer, notebook computer, etc.) to the board 1110, and a power switch 1116 for turning on/off the power to the board 1110, located on a side 1119 of the board 1110.

The board 1110 may include a face 1101 including an area 1102 for displaying a game logo (e.g., "Card Communication"), and a display area 1170 (e.g., large liquid crystal display (LCD) with or without a backlight) which includes a portion 1170*a* designated for displaying a 3-minute countdown, and a touchscreen portion 1170*b* which may be "touched" by hand to select a function (e.g., display names of players, display a question, display a response to a question, etc.) of the display 1170.

The face 1101 may also include an area for housing an audible device 1105 (e.g., speaker, buzzer, beeper, etc.) which may notify a player when a time is about to expire (e.g., 10 seconds), when time has expired, etc.

The face 1101 may also include an input area 1104 which includes input buttons for inputting information to the board 1110. For example, the input area 1104 may include a start button 1104*a*, stop button 1104*b*, pause button 1104*c*, shuffle button 1104*d*, arrow buttons 1104*e*-1104*h*, a select button 1104*i*, an added time button 1104*j* (e.g., for requesting additional time for responding to a question), and an automatic question button 1104*k* for requesting a question to be displayed automatically. The arrow buttons 1104*d*-1104*g* may be used to change the contents displayed on the display device 1170 as indicated in the legend in FIG. 11A.

Figures 11A, 11B, 11C, 11D:
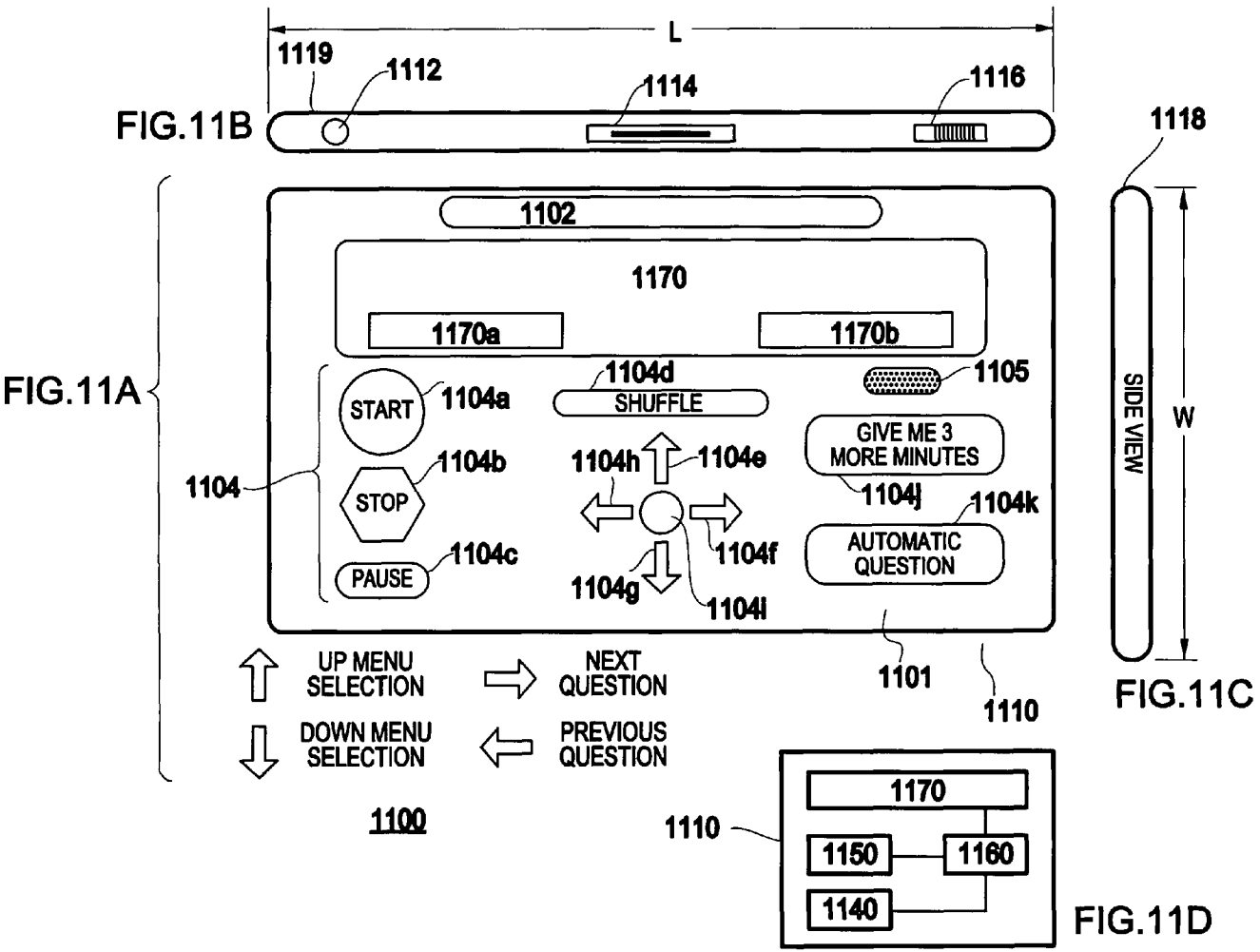
FIGS. 11A-11D illustrate a system 1100 for improving interpersonal communication according to the exemplary aspects of the present invention.

FIG. 11D illustrate a schematic of the circuit of the electronic board 1110. As illustrated in FIG. 11D, the board 1110 may include a memory device 1150 (e.g., random access memory (RAM)) for storing data (e.g., questions, players names, etc.), a memory device 1140 (e.g., read only memory (ROM)) for storing instructions in the form of code, and a microprocessor 1160 which may access the memory devices 1140, 1150 and may execute the code in order to perform the method according to the present invention. In addition, the microprocessor 1160 may be used to generate a display to be displayed on the display device 1170.

The board 1110 may also be small (e.g., handheld) so that it may be conveniently stored and transported. For example, as illustrated in FIG. 11C, the board 1110 may have a side 1118 having a thickness which is less than about 1 inch and a width, W, which is less than about 3 inches, and as illustrated in FIG. 11B, the board 1110 may have a length, L, which is less than about 6 inches.

The board 1110 may be used to download updates from an Internet webpage by connecting the board 1110 to a computer which accesses the Internet through the computer input port.

In addition, the board 1110 may be powered by using the power port 1112 to connect the board to a power supply (e.g., standard household 120V AC power supply), and/or may include a battery (e.g., rechargeable battery, non-rechargeable battery, etc.) and may be powered by either or both the 120V AC power supply and battery. In addition, instead of being connected to a computer via the input port 1114, the board 1110 may include a transmitter and receiver for wirelessly connecting to the computer (e.g., via BLUETOOTH® short range wireless connectivity standard, etc.).

With its unique and novel features, the claimed invention provides a method and system for improving interpersonal communication which may be used to improve a relationship between parties (e.g., husband and wife) and, thereby help to avoid future breaks or separations between the parties.

While the invention has been described in terms of one or more exemplary embodiments, those skilled in the art will recognize that the invention can be practiced with modification within the spirit and scope of the appended claims. Specifically, one of ordinary skill in the art will understand that the drawings herein are meant to be illustrative, and the design of the inventive assembly is not limited to that disclosed herein but may be modified within the spirit and scope of the present invention.

Specifically, it should be noted that the discussion above with respect to an Internet-based system may be equally applicable to a software-based system according to the exemplary aspects of the present invention. That is, the features of the Internet-based system could be provided by storing code (e.g., for performing the method of the Internet-based system) which is executable by a computer on a programmable storing medium (e.g., CD-ROM, etc.). In this case, the data stored in the webserver of the Internet-based system could be stored on the medium and/or the computer memory (e.g., hard-drive, RAM, ROM, etc.), and the displays generated by the webserver may instead be generated by a processor in the computer. Thus, for example, the parties could insert the medium (e.g., CD-ROM) storing the instructions into a computer (e.g., desktop, laptop, etc.) to perform a method of improving communication (e.g., playing a game on the computer) according to the exemplary aspects of the present invention.

Further, Applicant's intent is to encompass the equivalents of all claim elements, and no amendment to any claim the present application should be construed as a disclaimer of any interest in or right to an equivalent of any element or feature of the amended claim.

The invention claimed is:

1. A method of improving interpersonal communication between a plurality of parties, said method comprising:

executing a plurality of instructions on a processor to cause the processor to:

generate a display screen comprising a region for inputting a nature of a relationship between a first party of the plurality of parties and a second party of the plurality of parties which has a relationship with the first party, a region for displaying preliminary questions, a region for the first and second parties to input responses to the preliminary questions, a region for displaying a subject of discussion, and a region for inputting feedback;

develop a relationship profile for the first party and the second party, comprising:

directing said first party and said second party to answer the preliminary questions, a question of the preliminary questions having a plurality of possible responses, a possible response of the plurality of possible responses being associated with a score which is based on a scale comprising a first score which identifies a least communicative response, and a second score which identifies a most communicative response;

generating a first matrix which includes scores for responses of said first party to said preliminary questions in plural categories, a score of said scored responses being based on a willingness or ability of said first party to communicate with respect to issues represented by a category of said plural categories;

generating a second matrix which includes scores for responses of said second party to said preliminary questions in plural categories, a score of said scored responses being based on a willingness or ability of said second party to communicate with respect to issues represented by a category of said plural categories; and generating the relationship profile by summing the scores of said scored responses in the plurality of categories in the first and second matrices to generate a relationship profile matrix including a relationship score in the plurality of categories for the first party and the second party;

based on said relationship profile, identifying a weakness in communication between said first party and said second party;

selecting a plurality of subjects for discussion based on said identified weakness, said plurality of subjects comprising an emotional component and an intellectual component, and a subject of the selected plurality of subjects being displayed in the region for displaying a subject of the display screen;

providing a direction to the first party, the direction directing said first party to discuss the subject from said selected plurality of subjects with said second party for at least a predetermined period of time to improve communication between said first party and said second party in an area of said identified weakness;

directing the second party to provide feedback to the first party regarding the discussion of the subject by the first party, the feedback comprising a rating of the discussion of the subject by the first party for candor or willingness or ability to communicate; and updating the relationship profile based on the feedback.

2. The method of claim 1, wherein said plurality of subjects comprise at least one of financial issues between said plurality of parties, changes in priorities between said plurality of parties and sexual issues between said plurality of parties.

3. The method of claim 1, further comprising:

directing said second party to discuss a subject from said plurality of subjects with said first party for at least a predetermined period of time.

4. The method of claim 3, further comprising:

alternately repeating said directing said first party to discuss said subject, and said directing said second party to discuss said another subject.

5. The method of claim 4, further comprising:

after said alternately repeating said directing said first party to discuss said subject, and said directing said second party to discuss said another subject, directing said first party to discuss a communication relationship with said second party generally.

6. The method of claim 1, wherein said displaying said indicia comprises displaying said indicia on the display screen.

7. The method of claim 1, further comprising:

identifying a nature of said relationship between said first party and said second party, wherein the preliminary questions are based on the identified nature of the relationship between said first party and said second party.

8. The method of claim 1, wherein said generating said relationship profile comprises combining entries of said first and second matrices to generate a relationship profile matrix for said first party and said second party, and wherein said analyzing said relationship profile comprises analyzing scores in said relationship profile matrix.

9. The method of claim 1, further comprising:

weighting a question of said preliminary questions according to an importance given to said question by said first party and said second party, said scored responses in said first and second matrices reflecting said weighting of said questions.

10. The method of claim 1, wherein the directing of the second party to provide feedback comprises directing the second party to give a rating to the discussion of the subject by the first party, the relationship profile being updated based on a the rating given by the second party.

11. The method of claim 1, wherein the updating of the relationship profile comprises updating a score in the relationship profile matrix.

12. The method of claim 1, wherein the directing of the second party to provide feedback to the first party comprises directing the second party to provide feedback in the region for inputting feedback on the display screen.

13. A system for improving interpersonal communication between a plurality of parties, comprising:

a device which generates a display screen comprising a region for inputting a nature of a relationship between a first party of the plurality of parties and a second party of the plurality of parties which has a relationship with the first party, a region for displaying preliminary questions, a region for the first and second parties to input responses to the preliminary questions, a region for displaying a subject of discussion, and a region for inputting feedback;

a device which develops a relationship profile for the first party and the second party, said developing a relationship profile comprising:

directing said first party and said second party to answer the preliminary questions, a question of the preliminary questions having a plurality of possible responses, a possible response of the plurality of possible responses being associated with a score which is based on a scale comprising a first score which identifies a least communicative response, and a second score which identifies a most communicative response;

generating a first matrix which includes scores for responses of said first party to said preliminary questions in plural categories, a score of said scored responses being based on a willingness or ability of said first party to communicate with respect to issues represented by a category of said plural categories;

generating a second matrix which includes scores for responses of said second party to said preliminary questions in plural categories, a score of said scored responses being based on a willingness or ability of said second party to communicate with respect to issues represented by a category of said plural categories; and generating the relationship profile by summing the scores of said scored responses in the plurality of categories in the first and second matrices to generate a relationship profile matrix including a relationship score in the plurality of categories for the first party and the second party;

a device which, based on said relationship profile, identifies a weakness in a communication relationship between said first party and said second party;

a device which selects a plurality of subjects for discussion based on said identified weakness, said plurality of subjects comprising an emotional component and an intellectual component, and a subject of the selected plurality of subjects being displayed in the region for displaying a subject of the display screen;

a device which provides a direction to the first party, the direction directing said first party to discuss the subject from said selected plurality of subjects with said second party for at least a predetermined period of time to improve communication between said first party and said second party in an area of said identified weakness;

a device which directs the second party to provide feedback to the first party regarding the discussion of the subject by the first party, the feedback comprising a rating of the discussion of the subject by the first party for candor or willingness or ability to communicate; and a device which the relationship profile based on the feedback.

14. The system of claim 13, wherein said display screen is generated by an Internet website.

15. An Internet-based system for improving interpersonal communication between a plurality of parties, comprising:

a webserver connected to the Internet, a plurality of user terminals being connected to the webserver via the Internet, and comprising a display device, input device, memory which may store a web browser application, and microprocessor, wherein said webserver is accessible from said plurality of user terminals, and causes a user terminal of said plurality of user terminals to generate a display screen on the display device, said display screen comprising a region for inputting a nature of a relationship between a first party of the plurality of parties and a second party of the plurality of parties which has a relationship with the first party, a region for displaying preliminary questions, a region for the first and second parties to input responses to the preliminary questions, a region for displaying a subject of discussion, and a region for inputting feedback, wherein said webserver directs the first party and the second party to provide answers to the preliminary questions, and identify the nature of the relationship between the first and second parties, and input personal information, wherein based on the answers to the preliminary question, said webserver:

develops a relationship profile for said first party and said second party by:

directing said first party and said second party to answer preliminary questions, a question of the preliminary questions having a plurality of possible responses, a possible response of the plurality of possible responses being associated with a score which is based on a scale comprising a first score which identifies a least communicative response, and a second score which identifies a most communicative response;

generating a first matrix including scores for responses of said first party to said preliminary questions in plural categories, a score of said scored responses being based on a willingness or ability of said first party to communicate with respect to issues represented by a category of said plural categories;

generating a second matrix including scores for responses of said second party to said preliminary questions in plural categories, a score of said scored responses being based on a willingness or ability of said second party to communicate with respect to issues represented by a category of said plural categories; and generating the relationship profile by summing the scores of said scored responses in the plurality of categories in the first and second matrices to generate a relationship profile matrix including a relationship score in the plurality of categories for the first party and the second party;

based on said relationship profile, identifies a weakness in communication between said first party and said second party; and selects a plurality of subjects for discussion based on said identified weakness, said plurality of subjects comprising an emotional component and an intellectual component;

directs said first party to discuss a subject from said selected plurality of subjects, with said second party for at least a predetermined period of time to improve communication between said first party and said second party in an area of said identified weakness:

after a discussion of said subject by the first party, directs said second party to provide some feedback regarding the discussion of the subject, the feedback comprising a rating of the discussion of the subject by the first party for candor or willingness or ability to communicate; and wherein the webserver updates the relationship profile based on the feedback.

* * * * *